United States Patent [19]

Breeden

[11] 4,448,100

[45] May 15, 1984

[54] ROTARY SLICING TOOL FOR A FOOD PROCESSOR

[75] Inventor: John W. Breeden, Westport, Conn.

[73] Assignee: Cuisinarts, Inc., Greenwich, Conn.

[21] Appl. No.: 401,877

[22] Filed: Jul. 26, 1982

[51] Int. Cl.[3] ..... B26D 7/00

[52] U.S. Cl. ..... 83/355; 83/356.3; 83/592; 83/701; 241/92

[58] Field of Search ..... 83/355, 356 B, 701, 83/592; 241/92

[56] References Cited

U.S. PATENT DOCUMENTS

| | | | |
|---|---|---|---|
| 419,364 | 1/1890 | Schoell | 83/356.3 |
| 2,590,909 | 8/1952 | Westby et al. | 83/ |
| 3,032,067 | 5/1962 | Rodwick | 83/ |
| 3,892,365 | 7/1975 | Verdun | 241/92 |
| 3,985,304 | 10/1976 | Sontheimer | 241/92 |
| 4,198,887 | 4/1980 | Williams | 83/356.3 |
| 4,200,244 | 4/1980 | Sontheimer | 241/282.1 |
| 4,213,570 | 7/1980 | Jones | 241/282.1 |
| 4,216,917 | 8/1980 | Clare et al. | 241/92 |
| 4,226,373 | 10/1980 | Williams | 241/282.1 |
| 4,227,655 | 10/1980 | Williams | 241/92 |
| 4,277,995 | 7/1981 | Sontheimer | 83/355 |
| 4,369,680 | 1/1983 | Williams | 83/355 |
| 4,393,737 | 7/1983 | Shibata | 83/356.3 |

FOREIGN PATENT DOCUMENTS 1305187 8/1962 France .

*Primary Examiner*—Donald R. Schran
*Attorney, Agent, or Firm*—Parmelee, Bollinger & Bramblett

[57] ABSTRACT

A rotary food slicing tool is provided for use in a food processor of the type having a housing with a motor drive and a working bowl mountable on the housing which is adapted to encircle the food slicing tool. The tool has an elongated hub with a lower end coupling removably engageable with the motor drive for rotating the tool in the bowl about an axis of rotation. The rotary slicing tool in accordance with the present invention includes a disc-like member mounted on the upper end of the elongated hub. This disc-like member includes a raised rim having a skirt extending downwardly therefrom and an arcuate opening extending inwardly from the raised rim to a position near the center of the disc-like member. A raised platform on the disc-like member includes a rearwardly sloping arcuate shoulder and a leading edge which overhangs the trailing portion of the opening forming an elevated forward facing slot between the disc-like member and the raised platform. A U-shaped cutting blade has a front leg which forms the slicing surface. This front leg is mounted on the leading edge of the platform overhanging the slot opening. The rear leg of this U-shaped blade is mounted on the platform snug against the raised rim, thereby providing a strong, rugged cutting structure which produces clean, crisp cuts of food items fed into the working bowl onto the top of the disc-like member. The raised rim extends above the level of the U-shaped cutting blade a distance of approximately 1 millimeter all around the circumference of the disc-like member and prevents distortion or expansion of vegetables or other food products beyond the rim of the tool for avoiding unsightly or distorted slicing.

17 Claims, 8 Drawing Figures

Fig. 5.
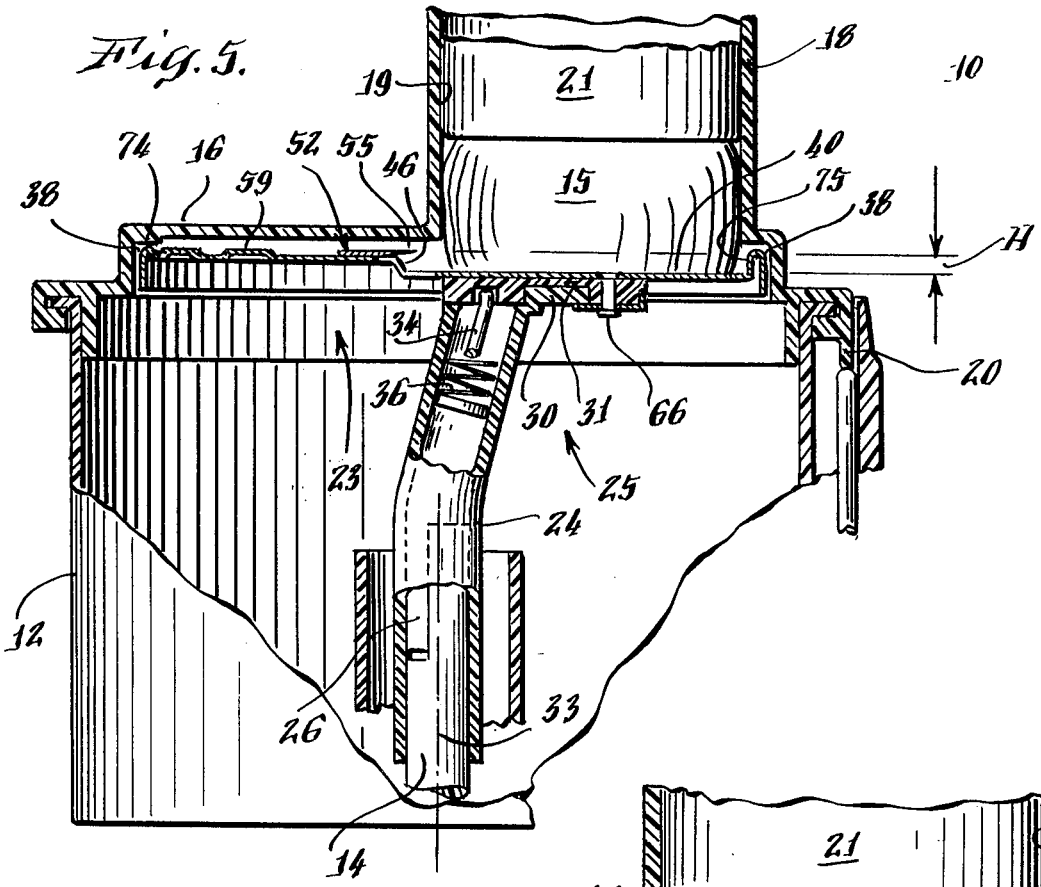
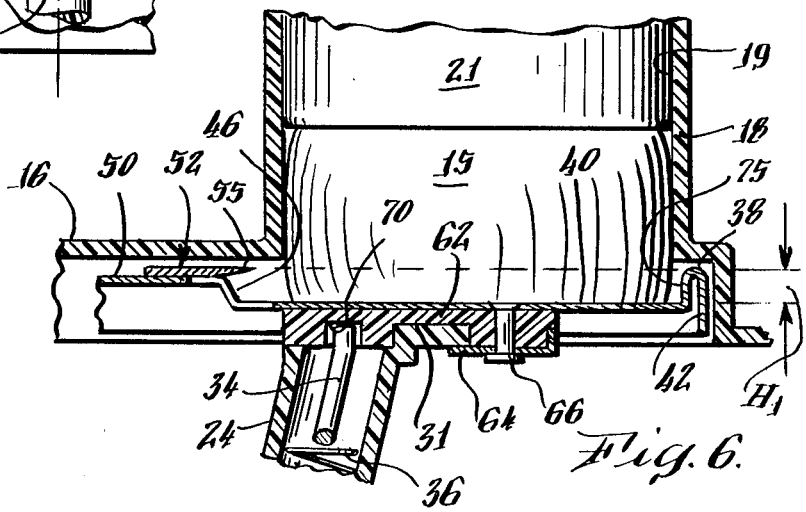
Fig. 6.
Fig. 7.
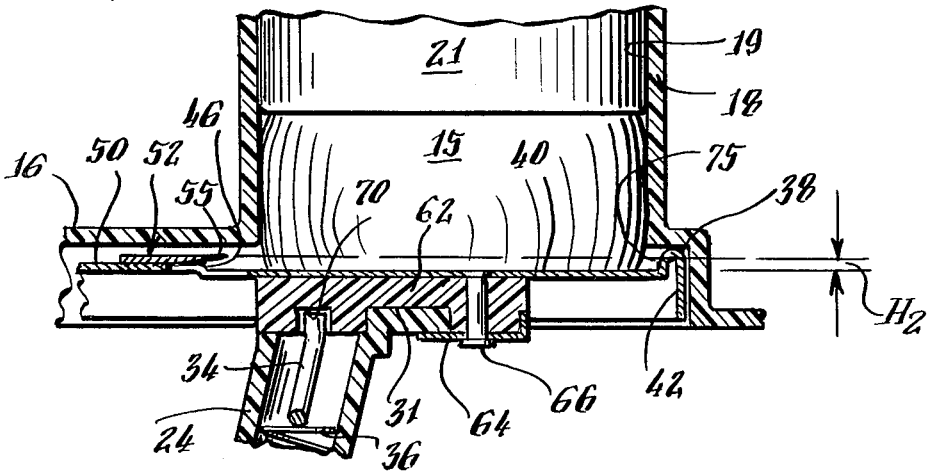

ROTARY SLICING TOOL FOR A FOOD PROCESSOR

FIELD OF THE INVENTION

This invention relates to rotary food processing tools for food processors, and more particularly to such rotary tools which have cutting means mounted on a generally horizontal disc-like member which rotates around a vertical axis in the bowl of the food processor.

BACKGROUND OF THE INVENTION

The present invention is applicable to food processors of the type having a working bowl with motor-driven tool drive means projecting into the bowl with which various selected rotary food processing tools can be engaged to be driven for performing various processing operations on food items in accordance with the desires of the user. A removable cover is secured over the top of the bowl during use. The cover includes a feed tube having a passageway which opens downwardly through the cover into the top of the bowl, and food items to be processed are placed in the feed tube and then are pushed down through the feed tube into the bowl by means of a removable food pusher which is adapted to slide down in the manner of a plunger through this feed tube. The food items are sliced or otherwise processed by the rotating tool located near the top of the bowl.

Additional information with respect to such food processors may be obtained by reference to U.S. Pat. Nos. 3,892,365 - Verdun; 3,985,304 - Sontheimer; 4,198,887 -Williams; 4,200,244 - Sontheimer; 4,216,917 - Clare and Sontheimer; 4,213,570 - Jones; 4,226,373 - Williams; and 4,227,655 -Williams.

Of particular interest to the present invention are food processing tools which are used for a slicing or cutting function for slicing or cutting fruits, vegetables and/or meat products. Such slicing tools have a horizontal disc-like member formed of sheet metal, preferably of stainless steel, which is mounted on elongated hub extending down into the bowl and which is coupled near its lower end to the motor-driven tool drive means which extends upwardly out of a housing for the motor drive. Generally, a horizontal cutting blade or structure is associated with or mounted upon the horizontal disc-like member near an opening in the disc. Thus, when food items are cut, they pass down through this opening into the bottom of the bowl.

One such rotary processing tool has the disc-like member mounted on an offset hub as described in the aforesaid Williams Pat. No. 4,227,655. This tool is particularly advantageous in that the slicing blade extends for substantially the entire radius of the disc-like member thereby advantageously enabling the slicing of larger food items for any given size of tool. Although the tool with offset hub as disclosed in this Williams patent provides an excellent advance in the art in permitting the slicing of larger food items, the blade and cutting structure in this tool as well as in other disc-like processor tools are generally characterized by extending to a level equal to or above the horizontal disc-like surface. This elevated position of the slicing blade can allow the blade to distort on the disc surface when attempting to slice very tough or frozen food items. Also, this elevated position of the slicing blade can cause difficulty when attempting to slice soft, hollow food items, or food items with internal cavities, for example such as tomatoes, peppers or squash which tend to distort or expand beyond the edge of the horizontal disc when they are applied to the top of that disc. This distortion of such food items is augmented by the elevated mounting structure of the blade being elevated above the disc.

SUMMARY OF THE INVENTION

Accordingly, it is the object of this invention to provide a new and improved rotary food slicing tool for a food processor which provides a clean, crisp cut without distorting or expanding the food items before the slice is made.

A further object of this invention is to provide a new and improved rotary food slicing tool which accommodates a heavier blade to produce significant cutting momentum and a powerful slicing impact.

A further object of this invention is to provide a new and improved rotary food slicing tool whose construction provides a neat, clean slicing action regardless of the thickness of the cut and provides a strong anchoring structure for the new and improved blade.

Among the advantages of this invention are those resulting from the fact that this new and improved rotary food slicing tool is adaptable to being mounted as a removable head as well as having a cutting surface which extends substantially the full radius of the disc on which the cutting blade is positioned, thereby achieving the advantages of the offset hub mounting, while the U-shaped blade has a front leg which provides a clean, neat reliable and consistently repeatable slicing operation, and the rear leg strengthens the anchorage of the blade to the disc and aids in counterbalancing the offset hub. Moreover, this rear leg extends along near the raised rim, thus providing additional mass integral with the front leg blade for increasing the momentum and power of the slicing or cutting action.

In carrying out this invention in one illustrative embodiment thereof, a rotary food slicing tool is provided for use in a food processor having an upright working bowl in which the rotary slicing tool is mounted for rotation. A removable cover is secured on the bowl during operation and a feed tube is used for feeding food items to the rotating tool in the bowl. In one preferred form, this tool has a removable tool head which is adapted to be mounted on an elongated hub shank having an upper head coupling portion and a lower drive coupling portion adapted to be coupled to and rotated by motor drive means. The rotary slicing tool has a horizontal disc-like member with a raised rim thereon having a skirt extended downwardly from this raised rim. An arcuate opening extends inwardly from the raised rim to a position near the center of the disc-like member. A raised platform on this disc-like member includes a rearwardly sloping arcuate shoulder, and a forward edge of this platform overhangs the trailing portion of the opening thereby forming an elevated forward facing slot between the horizontal disc-like member and the forward edge of the raised platform. A U-shaped cutting blade has a front leg on which the sharpened front surface forms the cutting edge. This front leg is mounted on the leading edge of the platform overhanging the opening, and the rear leg is mounted snug against the raised rim on the platform. The U-shaped configuration of this blade as well as the anchoring of the rear leg along near the rim and the increased mounting surface of this blade permits a relatively large number of spot welds to be spaced along both the forward and rear legs for strong anchoring to the platform and advantageously produces a rugged slicing blade structure. The rear leg of the U-shaped blade being near the rim creates significant angular momentum with a resultant powerful cutting impact. The raised rim on the horizontal disc-like member is elevated above the level of the U-shaped blade approximately 1 millimeter all around the perimeter of the disc-like member for confining and resisting radial expansion or distortion of food items which are fed through the feed tube to the top of the rotating slicing tool thereby preventing ragged cuts or the smashing of portions of soft or readily distorted food items between the rim of the rotary blade and the bowl. A radially outwardly projecting tab on the blade adjacent to its cutting edge fits into a slot in the raised rim thereby positively holding the cutting edge down while also preventing snagging of food items between blade and rim. The structure is sturdy and rugged and provides a neat, clean cutting action.

Advantageously, the raised rim extending all around the disc-like member provides a bearing surface engageable with a bearing pad on the underside of the cover in the region of the cover opposite to the feed tube for preventing scratching of the cover.

Further, the raised rim has a peripheral skirt depending from it, and this rim-skirt enables all of such tools to have a uniform rim-skirt height, regardless of the depressed level of the disc-like member relative to the elevated platform on which the blade is mounted. Thus, the various slicing tools have a neat uniform appearance, regardless of their relative platform and disc levels for producing the different slicing thicknesses.

BRIEF DESCRIPTION OF THE DRAWINGS

The invention, together with further aspects, objects, features and advantages thereof will be more clearly understood from a consideration of the following description taken in conjunction with the accompanying drawings in which like elements are designated with the same reference numerals throughout the various FIGURES.

This description describes the best mode I now contemplate for putting the present invention into practice.

FIG. 2 is drawn at a somewhat smaller size than FIG. 1.

FIG. 4 is drawn approximately full size.

FIG. 5 is a sectional, elevational view of the rotary slicing tool of FIG. 1, illustrating this slicing tool in the form of a removable head mounted on its elongated hub in the bowl of a food processor with the cover positioned thereon.

FIG. 6 is a partial elevational cross-sectional view similar to FIG. 5 illustrating another removable tool head arranged for cutting a thicker slice than that made by the cutting tool of FIG. 5.

FIG. 7 is a partial elevational sectional view similar to FIG. 6 illustrating a third removable tool head arranged for cutting a thinner slice than in either FIG. 5 or 6. This thinner slice is produced by reducing the vertical distance between the blade and the horizontal disc-like surface or deck of the rotary slicing tool.

DESCRIPTION OF THE PREFERRED EMBODIMENTS

Figure 1:
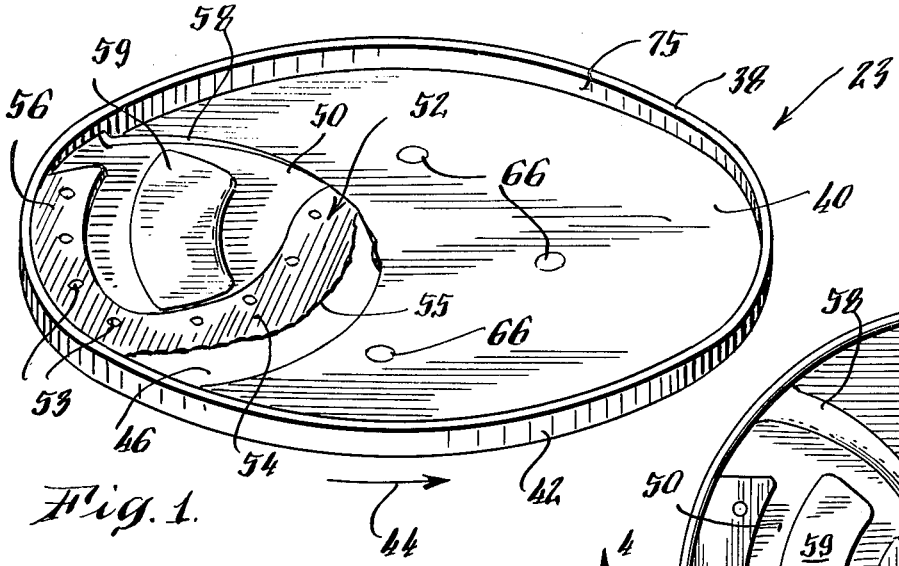
FIG. 1 is a perspective view of the top of a rotary slicing tool embodying the present invention.
Figure 2:
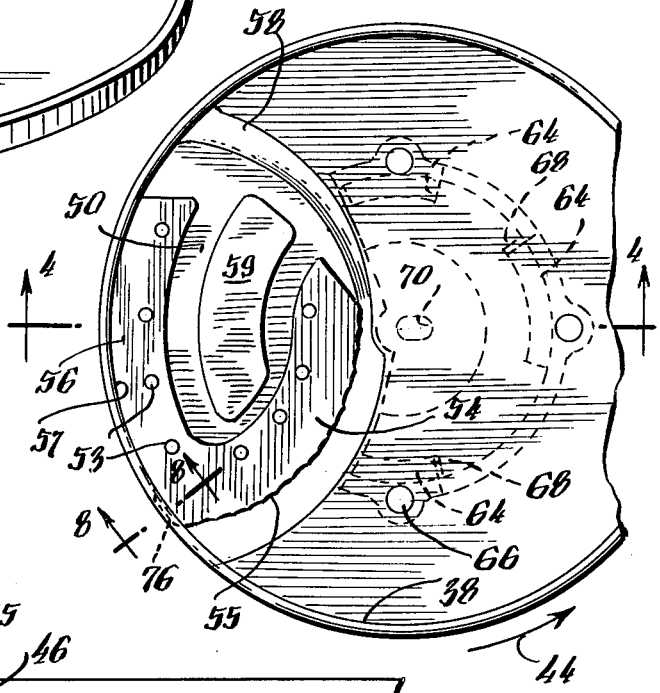
FIG. 2 is a top view of the rotary slicing tool shown in FIG. 1.

Before describing in detail the rotary food slicing tool embodying the present invention, reference is first made to FIG. 5 which illustrates a portion of a food processor, indicated generally with the reference numeral 10. The food processor 10 includes an upright working bowl 12 with motor-driven tool drive means 14 in the form of a shaft extending up into the bowl 12. A removable cover 16 having a feed tube 18 extending through the cover closes the bowl 12 during operation of the food processor. When this cover is in its closed position a cam surface 20 on the cover depresses an actuator rod 22 which closes a switch (not shown) to enable the operation of drive means in the form of a motor (not shown) for driving the tool shaft 14. The feed tube 18 provides a feed passageway 19 for introducing the food item 15 (or multiple items simultaneously) to be processed into the working bowl 12. A removable hand held food pusher 21 is adapted to be slid down into the passageway 19 for pushing the food items against the rotating tool.

This rotary food slicing tool, referred to generally by the reference number 25 (FIG. 5), includes a disc-like tool head 23 (see also FIG. 1) which is positioned near the cover 16. This tool 25 includes an elongated hub 24 with lower coupling means 26, for example such as a hollow shank with a key or a spline or non-circular socket region at the lower end of the elongated hub 24 adapted to be coupled to the motor driven tool drive means 14 for rotating the rotary slicing tool 25. The upper end of elongated hub 24 carries an upper coupling flange member 30. This flange member 30 is removably engageable in a socket 31 on the underside of the tool head 23 so that the elongated hub 24 can be removed from the tool head for convenient storage. This removable tool head socket 31 and the coupling 30 are described more fully and claimed in an application entitled, Removable Head Rotary Tool For Food Processors, Ser. No. 274,720 by Williams et al, filed June 18, 1981, which is assigned to an affiliate of the assignee of the present invention.

The preferred form of the slicing tool of the present invention included such a removable tool head and accordingly is illustrated as having a removable head. It is to be understood, however, that the rotary slicing tool in accordance with the present invention is not limited to a tool having such a removable head structure and is applicable to a unitary tool in which the tool head 23 is permanently affixed to and forms a part of the hub 24. The upper portion of the elongated hub 24 and its mounting location on the tool head 23 are shown as being radially offset from the axis of rotation 33. This radial offset hub structure is preferred to obtain the advantages set forth in the Williams Pat. No. 4,227,655 referred to previously. These advantages include the capability of slicing increased sizes of food items for a given size of tool head.

The upper end of the elongated hub 24 houses locking means in the form of a spring-loaded locking member 34 having a spring 36 which urges the locking member upwardly, such that it protrudes out of the upper end of hub 24. A manual release button (not shown) is attached to this locking member which is adapted to retract it inward into the bore of the hub 24 to release it from its locking engagement with the socket 31 of the removable tool head 23. This locking means 34, 36 is described more fully and claimed in the Williams patent.

The rotary food slicing tool 25 as illustrated in FIGS. 1 through 4 has a removable head 23 incorporating the slicing structure in accordance with the present invention. This tool head 23 includes a horizontal disc-like member 40 of stainless steel having an upstanding or elevated rim 38 on the periphery thereof with a depending peripheral skirt 42 extending down from the elevated rim. The horizontal disc-like member 40 has an arcuate opening 46 formed in its horizontal surface which extends from a region near the center of the member 40 out toward and adjacent to the elevated or upstanding rim 38. The tool 25 rotates in a counterclockwise direction as shown by the arrow 44. The region behind the opening 46 is formed into an elevated platform 50 having an arcuate front lip 48 (FIG. 4) forming the leading edge of the platform.

A U-shaped slicing blade 52 having an arcuate front leg 54 and a rear leg 56 is mounted on the platform 50 by spot welding as indicated by the spot welds 53. The front leg 54 is mounted on the lip 48 of the platform 50. The arcuate leading edge portion of this front leg 54 projects forwardly approximately one-half of an inch beyond the arcuate lip 48 of the platform, thereby partially overlying the opening 46, with this front blade edge 55 being sharpened forming the slicing cutting edge. This cutting edge 55 is illustrated as having a sharp slightly scalloped or serated configuration and it projects forwardly partially over and above the arcuate opening 46. This arcuate opening 46 may be characterized as being a clearance slot through which food items cut by the blade edge 55 may pass.

The rear leg 54 of the U-shaped slicing blade 52 is mounted close against the rim 38 of the platform 50, and it has the same peripheral arcuate configuration as the rim for providing a complimentary closely fitting abutting structure of the periphery of this blade seating close against the elevated rim 38, when the blade 52 is mounted on the platform 53. In other words, the curved periphery 57 of this rear leg 54 has the same radius of curvature as the inner surface of the raised rim 38 so that this periphery 57 seats snuggly against the rim for providing a strong mounting relationship between this blade and the platform 50 on the disc-like member 40. It is to be noted that the rim 38 extends to an elevation above the U-shaped blade 52 at all points around the perimeter of this rim for reasons which will be explained hereinafter.

The elevated platform 50 has a gradually downwardly sloping rear shoulder 58 extending around and behind the elevated platform 50 in a more or less arcuate configuration. This gradually sloping shoulder 58 extends from the inner end of the opening 46 out to the elevated rim 38. A raised arcuate area 59 is formed in said platform between the front and rear legs 54 and 56 of the U-shaped slicing blade for strengthening the platform. The top surface of this raised area 59 is at approximately the same level as the top surface of the blade 52 for providing an effectively smooth top surface. The configuration of the platform 50 and that of the opening as well as the mounting of the U-shaped slicing blade 52 on top of the platform facilitate the slicing of food items being processed by the food processor 10. As the items are sliced they pass through the slot 46 and drop down into the bowl 12 with as little interference as possible from this slicing structure.

Advantageously both the front and rear legs 54 and 56 of the blade 52 are spot welded to the elevated platform 50 for providing very strong attachment of this blade to the platform. For example, four spot welds 53 are approximately uniformly spaced along the front leg 54; three more spot welds 53 are approximately uniformly spaced along the rear leg 56; and an eighth spot weld is located in the bight of the U-shaped blade near the junction of the front and rear legs.

Figure 3:
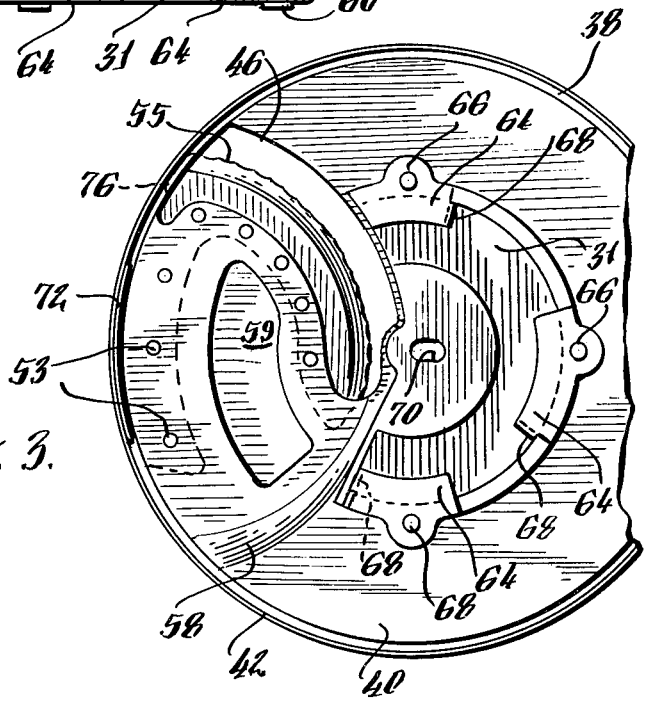
FIG. 3 is a bottom view of the rotary slicing tool as shown in FIG. 2.

As seen in FIG. 3, the socket 31 on the underside of the horizontal disc-like member 40 of the removable head 23 provides means for detachably mounting the removable slicing tool head 23 on the elongated hub 24 as discussed above. This socket 31 includes a plurality of spaced retainers 64 attached by rivets 66 to the horizontal disc-like member 40. Each retainer 64 is open at one end and has a stop 68 positioned on the opposite end for limiting the relative turning movement of the hub for capturing peripheral teeth portions of the upper coupling member 30 (FIG. 5) in engagement in the socket 31. The socket 31 has a locking recess 70 which is adapted to receive and capture the end of the spring-loaded retractable locking member 36 as described and claimed in said Williams et al application.

As is indicated on the right hand poriton of FIG. 5, the thickness "H" of the slice which is made in food items by this tool is determined by the vertical distance between the cutting edge 55 of the slicing blade 52 and the top surface of the horizontal disc-like member 40. In FIG. 6 the thickness "$H_1$" is greater while in FIG. 7 the thickness "$H_2$" is less than "H" in FIG. 5.

Thus, it will be understood that the slicing thickness of any particular blade depends upon this height difference H, $H_1$ or $H_2$, and so forth. Any desired slicing thickness in the range from 1 mm to 8 mm can be achieved by manufacturing the tool head 23 with the platform 50 appropriately elevated relative to the top surface of the disc-like member 40. In each of these embodiments of FIGS. 5, 6 and 7 it is to be noted that the height of the skirt 42 attractively remains the same, while the vertical distance H, $H_1$ or $H_2$ between the blade 52 and the upper surface of the horizontal disc-like member 40 is established in accordance with the desired slice thickness which is to be produced.

The elevated rim 38 is always at an elevation at least 1 mm above the upper surface of the U-shaped slicing blade 52. This high bead advantageously formed by the rim 38 prevents distortion or expansion of a food item 15 beyond the edge of the horizontal disc-like member 40. In other words the food is constrained or held radially inwardly by this elevated rim bed 38, thereby providing a clean, neat, crisp cut in the food items. This elevated rim prevents damaging of the food item by confining it to prevent any portion of it becoming lodged between the bowl 12 and the fast rotating perimeter of the tool head 23.

Moreover, this elevated rim bead 38 is adapted to serve as a continuous bearing surface in cooperation with a small bearing pad 74 (FIG. 5) located on the underside of the cover 16 on the opposite side from the location of the feed tube 18. This bearing pad 74 may be molded integral with the cover, which is formed of tough, rigid, plastic material. The rim 38 can bear against this pad 74, thereby preventing the entire remainder of the undersurface of the cover from coming into contact with any portion of the tool head. A plurality of such bearing pads 74 may be used if desired. The elevated rim 38 is formed by the metal of the disc-like member 40 being formed up into a food-controlling wall 75 and being rounded over into a rounded inverted U-shaped bead 38 and down into the skirt 42. By virtue of the fact that the skirt 42 of each tool has the same vertical height, there is an attractive uniform appearance of all tool heads 23 regardless of the particular slicing thickness H, $H_1$ or $H_2$ and so forth.

With this particular U-shaped blade construction in which the rear leg 56 thereof fits completely snuggly at its periphery 57 and abuts against the rim 38, a clean, neat, crisp slice is provided. The rear leg 56 being integral with the front cutting leg 54 and being located along the rim at a large radius from the axis 33 of rotation increases the mass of the U-shaped blade 52 considerably above the ordinary blade, thereby advantageously increasing the angular momentum of the revolving blade for providing a powerful cutting impact.

Figure 8:
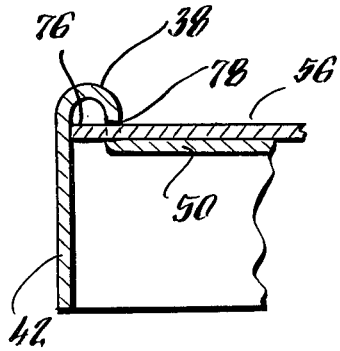
FIG. 8 is an enlarged partial sectional view taken along the line 8—8 in FIG. 2 showing a tab on the blade inserted into a slot in the raised rim.

In order to anchor the blade even more strongly onto the disc-like member 40, there is shown a tab 76 (FIGS. 2 and 8) projecting radially outwardly from the periphery 57 of the blade. This outwardly projecting tab 76 is located adjacent to the cutting edge 55 at the bight of the U-shaped blade. This tab 76 snuggly fits into a slot 78 (FIG. 8) cut into the food-controlling wall 75 of the raised rim 78 in a plane parallel to the elevated platform 50. Thus, advantageously, the cutting edge 55 is prevented from flexing upwardly when it impacts against tough objects. Also, by virtue of the fact that this tab is inserted into the food-controlling wall 75, food items cleanly cut are prevented from snagging in the narrow space between the blade periphery 57 and the raised rim 38.

Figure 4:
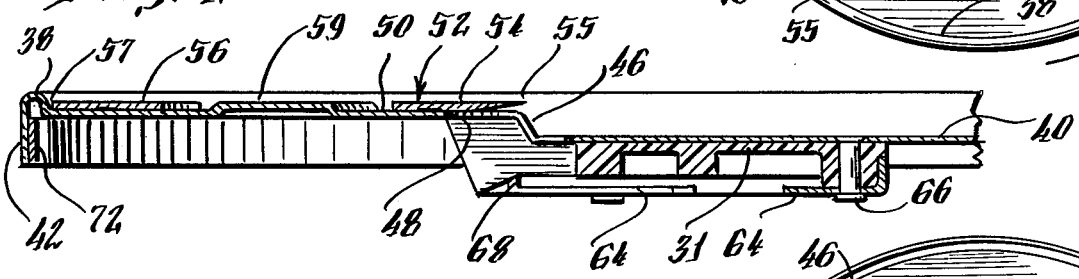
FIG. 4 is a partial cross-sectional view taken along line 44 of FIG. 2, and shown enlarged.

As will be seen in FIGS. 3 and 4 an arcuate counterweight 72 may be mounted on the inner surface of the skirt 42 for counterbalancing the offset socket 31 and the offset upper portion of the elongated hub 24, both of which are offset from the axis of rotation 33. In tool heads 23 for making the thickest slices, the base portion 62 (FIG. 6) of the socket 31 is relatively thin, and thus less counterbalancing is required, and so the counterweight 72 may be omitted. The rear leg 46 above may provide the appropriate counterbalancing effect for thick-slicing tools.

A rotary slicing tool is thus provided which is heavier, stronger and provides more powerful cutting impact for the food items applied thereto. The construction of the U-shaped blade provides two legs which are securely spot welded to the elevated platform. This tool has an elevated food-constraining rim 38 with the wall 75 which resists distorting the food applied to this tool. The increased surface of the U-shaped blade configuration plus the raised region 59 provides more surface area for sliding smoothly beneath the food items being cut.

Since other changes and modifications varied to fit particular operating requirements and environments will become understood by those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A rotary tool for use in a food processor of the type having a housing with motor drive means and a working bowl mountable on the housing and in which the rotary tool has an elongated hub with a lower end including coupling means removably engageable with said motor drive means for rotating said tool in said bowl about the axis of rotation of said coupling means, said rotary tool including a horizontal disc-like member rotatable by said elongated hub in a predetermined direction of rotation, a raised rim extending around the periphery of said disc-like member having a skirt extending downwardly therefrom, an arcuate opening extending inward from said raised rim to a position near the center of said disc-like member, a raised platform located immediately behind said opening with respect to said direction of rotation having a rearwardly sloping shoulder, the forward edge of said platform overhanging the trailing portion of said opening for forming an elevated slot between the disc-like member and the forward edge of said raised platform, a U-shaped cutting blade having a front leg and a rear leg, said front leg of said U-shaped blade being mounted on the forward edge of said platform with the leading edge portion of said front leg overhanging said slot, said leading edge portion being sharpened for forming the cutting edge of said U-shaped blade, the rear leg also being mounted on said platform, said rear leg having an arcuate peripheral configuration matching the curvature of said raised rim and being mounted snug against said raised rim with said rim at all points around the circumference of said disc-like member being at an elevation above said cutting blade for providing a clean, neat cut of food items which are fed to the top of said horizontal disc-like member with said raised rim preventing the radial expansion or distortion of said food items outwardly into the region between the rotary tool and the bowl in which it is being operated.

2. The rotary tool as claimed in claim 1 in which:

said rim at all said points extends at least one millimeter above the upper surface of said U-shaped cutting blade.

3. The rotary tool as claimed in claim 1 in which:

said platform has a raised area extending between the front and rear legs of said U-shaped cutting blade on said platform.

4. The rotary tool as claimed in claim 3 in which:

said raised area is arcuate in over-all configuration and dominates the area on said platform between said front and rear leg.

5. The rotary tool as claimed in claims 1, 2, 3 or 4 in which:

said U-shaped blade is mounted on said platform by welding said blade along both of said front and rear legs to said platform.

6. A rotary food processing tool for use in a food processor of the type including a housing containing an electric motor drive, a bowl mountable on said housing for enclosing a rotary food processing tool positioned on a hub within said bowl, said tool being adapted to be rotated within said bowl by said electric motor drive, a removable cover adapted to be received in position on said bowl during operation of the food processor, and a feed tube on said cover forming a passageway for feeding food items through said cover into said bowl, said rotary food processing tool comprising:

a horizontal disc-like member rotatable by said hub in a forward direction of rotation and having an elevated rim with a downwardly extending skirt surrounding the periphery of said disc-like member, an arcuate opening extending from said elevated rim inwardly generally near the center of said disc-like member, a raised platform immediately behind said opening and having a rearwardly sloping shoulder, the forward edge of said platform overhanging said opening forming an arcuate elevated slot in said disc-like member, a U-shaped cutting blade having arcuate shaped front and rear legs, the front leg having a cutting edge thereon and being mounted on said platform with said cutting edge over-hanging said arcuate elevated slot and extending out all the way to said elevated rim the rear arcuate leg of said cutting blade being mounted on said platform with its outer edge snug against said elevated rim, said elevated rim having an elevation which extends above the upper surface of said blade mounted on said platform for guiding food items as the food is rotating to said cutting edge and for limiting the distortion of the food item as it is being impacted during the cutting action of said cutting edge.

7. The rotary food processing tool as claimed in claim 6, in which:

said U-shaped blade is integrally formed, and said arcuate rear leg is located close to said rim for providing a strong mounting of said blade on said platform and for providing significant angular momentum to give a powerful cutting impact against food items by virtue of the fact that a large portion of the mass of the integral blade is located as far as possible from the axis of rotation of said disc-like member.

8. The rotary food processing tool as claimed in claim 6 or 7 in which:

said rim extends at least one millimeter above the upper surface of said U-shaped cutting blade.

9. The rotary food processing tool as claimed in claim 6 or 7 having:

an arcuate raised region extending between the legs of said U-shaped cutting blade on said platform the top surface of said arcuate raised region being level with the top surface of said U-shaped blade, and said arcuate raised region being concentric about the axis of rotation of said disc-like member.

10. The rotary food processing tool as claimed in claims 6 or 7 in which:

said U-shaped blade is mounted on said platform by welding said blade along both of said front and rear legs to said platform.

11. The rotary food processing tool as claimed in claim 6 or 7, in which:

said elevated rim is adapted to serve as a bearing surface for engaging against a localized bearing pad on the underside of the cover.

12. The rotary food processing tool as claimed in claim 6 or 7, in which:

said elevated rim includes an approximately vertical wall portion extending up from said disc-like member, a rounded bead extending along the top of said wall, and a peripheral skirt extending down from said bead to a level below the level of the deck portion of said disc-like member.

13. The rotary food processing tool as claimed in claim 12, in which:

said rounded bead of said rim is adapted for serving as a bearing surface for engaging against a localized bearing pad on the underside of the cover.

14. The rotary tool as claimed in claim 1, 2, 3 or 4, in which:

said raised rim has a slot therein extending in a plane parallel with the raised platform, and at least a portion of the peripheral configuration of said blade near the cutting edge of said blade projects out fitting snuggly into said slot for firmly anchoring the leading edge portion of the blade and for preventing food items from snagging between the raised rim and the peripheral configuration of said blade.

15. The rotary tool as claimed in claim 1, 2, 3 or 4, in which:

the disc-like member is mounted onto the elongated hub in a region offset from the axis of rotation on the opposite side of said axis from the location of said U-shaped blade, and said rear leg of said blade acts at least partially as a counter-weight for balancing the offset hub mounting with respect to rotation about said axis.

16. The rotary food processing tool as claimed in claim 6 or 7, in which:

said disc-like member is mounted onto said elongated hub in a region offset from the axis of rotation on the opposite side from the location of said U-shaped blade, and said rear leg of said blade acts at least partially as a counter-weight for balancing the offset hub mounting with respect to rotation about said axis.

17. The rotary food processing tool as claimed in claim 12, in which:

said approximately vertical wall portion of said elevated rim includes a slot extending in a plane parallel with said raised platform, and at least a portion of the outer edge of said blade near said cutting edge projects radially outwardly into said rim slot, snuggly fitting into said rim slot for anchoring the front leg against flexing upwardly during cutting impact and for preventing snagging of food items between said elevated rim and the outer edge of the blade.

* * * * *